United States Patent [19]

Hollendorfer, Jr.

[11] 3,995,856

[45] Dec. 7, 1976

[54] TENNIS RACKET GRIP

[75] Inventor: Frank G. Hollendorfer, Jr., 839 Renninger Road, Akron, Ohio 44319

[73] Assignee: Eaton Corporation, Cleveland, Ohio

[22] Filed: June 3, 1975

[21] Appl. No.: 583,497

[52] U.S. Cl. ..... 273/75; 74/551.9; 145/61 R; 273/81 R

[51] Int. Cl.[2] ..... A63B 49/08

[58] Field of Search ..... 273/67 R, 67 D, 67 DA, 273/67 DB, 68, 72 R, 72 A, 73 R, 73 J, 75, 81 R, 81 B, 81.4, 81.5, 81.6; 43/18 R; 145/61 R, 61 C, 61 D; 74/551.9, 558, 558.5; 81/121 R

[56] References Cited

UNITED STATES PATENTS

| | | | |
|---|---|---|---|
| 399,340 | 3/1889 | Morgan | 273/75 |
| 1,983,756 | 12/1934 | Hessmert | 74/551.9 |
| 2,121,989 | 6/1938 | Schnase et al. | 273/81 B X |
| 2,871,899 | 2/1959 | Coyle et al. | 273/81 R X |
| 2,961,905 | 11/1960 | Stumpf | 81/121 R |
| 3,079,819 | 3/1963 | Wing | 81/121 R |
| 3,324,748 | 6/1967 | Williams | 81/121 R |
| 3,469,839 | 9/1969 | Pietronuto et al. | 273/72 R X |

FOREIGN PATENTS OR APPLICATIONS

| | | | |
|---|---|---|---|
| 556,110 | 4/1923 | France | 273/81 R |
| 804,757 | 8/1936 | France | 74/551.9 |
| 199,786 | 6/1923 | United Kingdom | 273/75 |
| 651,817 | 4/1951 | United Kingdom | 273/81 R |

*Primary Examiner*—Richard J. Apley
*Attorney, Agent, or Firm*—Teagno & Toddy

[57] ABSTRACT

A molded, one-piece, slip-on grip for non-rotational retention on the elongated handle of a tennis racket or the like is provided. The grip has an internal configuration designed to closely conform with many of the various cross-sectionally differently shaped handles utilized with commercially available tennis rackets. Flats of an isosceles triangular configuration are provided equally spaced around the closed end and adjacent to the end cap to provide a gripping surface.

5 Claims, 7 Drawing Figures

TENNIS RACKET GRIP

BACKGROUND OF THE INVENTION

1. Field of the Invention

This invention relates to grips for tennis rackets and the like and more particularly relates to molded, one-piece, slip-on grips having a particular internal configuration for closely conforming to and being non-rotationally retained on elongated tennis racket handles of various cross-sectional shapes.

2. Description of the Prior Art

The prior art contains many molded, one-piece, slip-on grips for use on the elongated handles of tennis rackets, golf clubs and the like. Examples of such grips may be seen by reference to U.S. Pat. Nos. 3,848,871; 3,674,267 and 3,833,218.

The prior art molded, one-piece grips for tennis rackets have been less than totally satisfactory as the grips were difficult to assemble to the handles, tended to spin or rotate relative to the handles unless specifically configured to conform to the particular tennis racket handle or fixed thereto as by a screw or the like and/or tended to fit the handle poorly causing the grip to feel uncomfortable to the user. Specifically internally configured grips create a production and inventory problem in view of the many different configurations which would be required to accommodate the many differently shaped tennis racket handles while fixing the grip to the handle is an expensive assembly operation and often results in a less than satisfactory tennis racket.

SUMMARY OF THE INVENTION

In accordance with the present invention, the drawbacks of the prior art have been overcome to the extent that an easily applied, one-piece, molded, slip-on grip for non-rotational retention on the elongated handles of most popular tennis rackets is provided. The elongated handles of most popular tennis rackets are of an octagonal cross-sectional shape. However, the type and size of the octagonal cross-sections vary from brand-to-brand and from model-to-model.

The molded, one-piece, slip-on grip of the present invention is generally annular in exterior cross section and has an interior surface having a plurality of flats formed therein defining a substantially equilateral sixteen sided polygon adjacent the closed end thereof. The grip is of a resilient material such as a rubber compound or the like, which, in combination with the equally spaced flats molded in the interior surface, allows the grip to closely conform to the various octagonal cross sections of tennis racket handles.

Accordingly, it is an object of the present invention to provide a new and improved grip for non-rotational retention in the elongated handles of tennis rackets.

Another object of the present invention is to provide a new and improved, one-piece, molded, slip-on grip for non-rotational retention on commonly available, cross-sectionally octagonally shaped tennis racket handles wherein the internal surface of grip adjacent the closed end thereof has equally spaced flats formed therein to define a generally equilateral polygon of sixteen sides.

These and other objects and advantages of the present invention will become apparent from a reading of the description of the preferred embodiment taken in connection with the attached drawings.

DESCRIPTION OF THE PREFERRED EMBODIMENT

Figure 1:
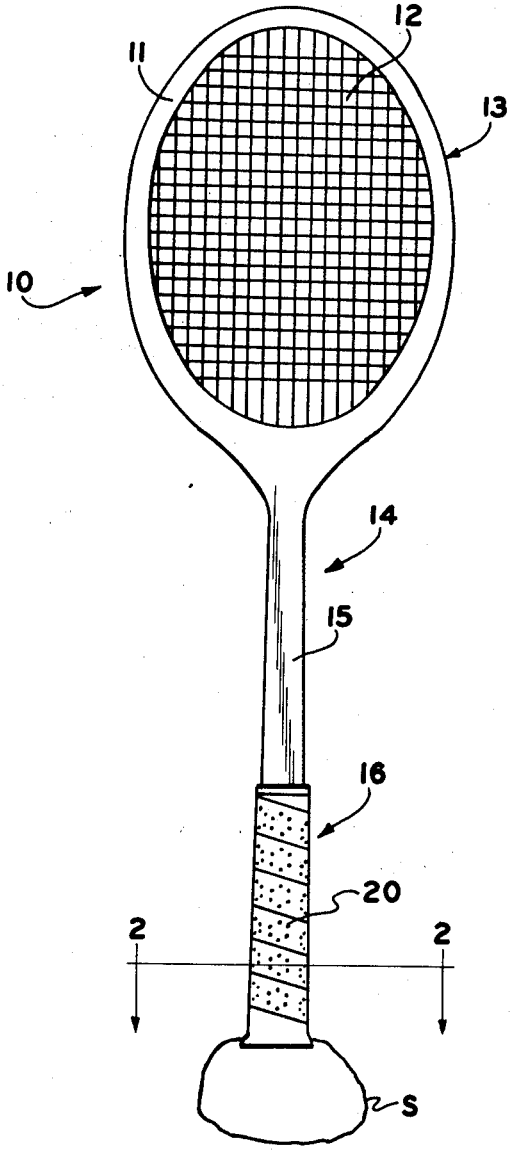
FIG. 1 is a front elevational view of a tennis racket utilizing the grip of the present invention.

A racket 10 of the type used in tennis may be seen by reference to FIG. 1. It is understood that the term tennis racket as used herein is intended to include rackets of the type utilized for squash, paddle tennis, paddle ball, racquet ball, badminton and the like as well as rackets utilized to play lawn tennis. The racket 10 comprises a frame 11 having strings 12 therein or an equivalent ball striking surface. The frame 11 includes a head portion 13 and a handle portion 14. The handle portion 14 includes a shank portion 15 and a grip portion 16. A molded, one-piece, slip-on grip 20 is received on the grip portion 16 of the handle 14. The frame may be wooden, aluminum, stainless steel, plastic, laminated fiberglass or a combination thereof as is well known in the art. The racket 10 may include an optional wrist strap S to prevent the racket from unintentionally leaving the users hand.

The grip portion 16 of the handle 14 of most tennis rackets is generally of an octagonal cross-sectional shape comprising eight sides 17 and eight corners 18 allowing the user to modify his grip on the racket for serving, forehanded or backhanded play. However, the octagonal handle shapes available from the various manufacturer often differ in configuration and size and also differ from model-to-model offered by the same manufacturer. Examples of this difference may be seen by comparison of the structures illustrated in FIGS. 2A, 2B and 2C.

Figure 2A:
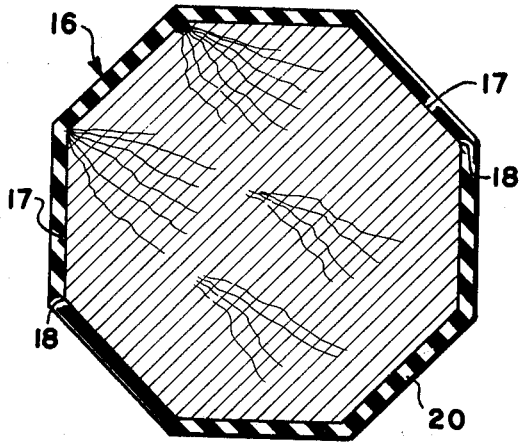
FIGS. 2A, 2B and 2C are cross-sectional views taken along the line 2—2 in FIG. 1 of various different octagonally shaped tennis racket handles.
Figure 2B:
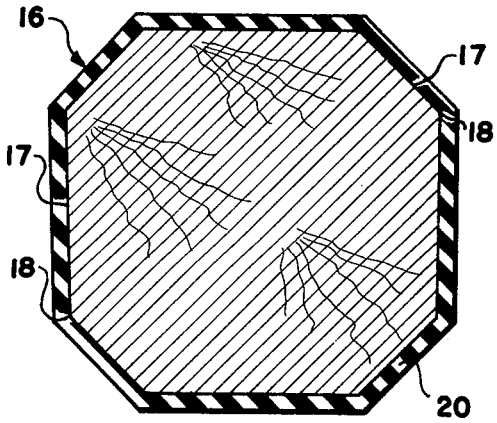
Figure 2C:
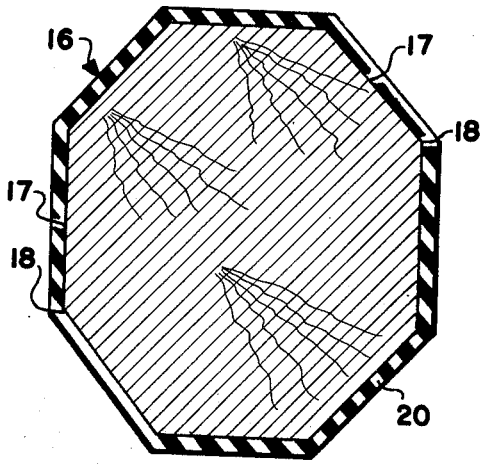

The handle cross-section seen in FIG. 2A is an equilateral octagon and handles of this shape are available on certain rackets sold under the DUNLOP trademark. FIG. 2B illustrates a cross-sectionally non-equilateral octagonally shaped handle available on certain rackets sold under the WILSON trademark. FIG. 2C illustrates a different handle of non-equilateral octagonal cross-section available on certain rackets sold under the BANCROFT trademark. Other tennis rackets sold under the above and/or other trademarks are available with handles of different octagonal cross-section.

It may thus be seen that attempts to provide molded grips having specifically configured interior surfaces designed to conform to a specific tennis racket handle would result in undue duplication of manufacturing equipment such as molds, undue production and scheduling problems and undue inventory problems.

The grip 20 of the present invention solves the above mentioned problems by having an internal configuration which will adapt to the cross-sectional shapes of most commercially available tennis racket handles for non-rotational retention thereon.

Figure 3:
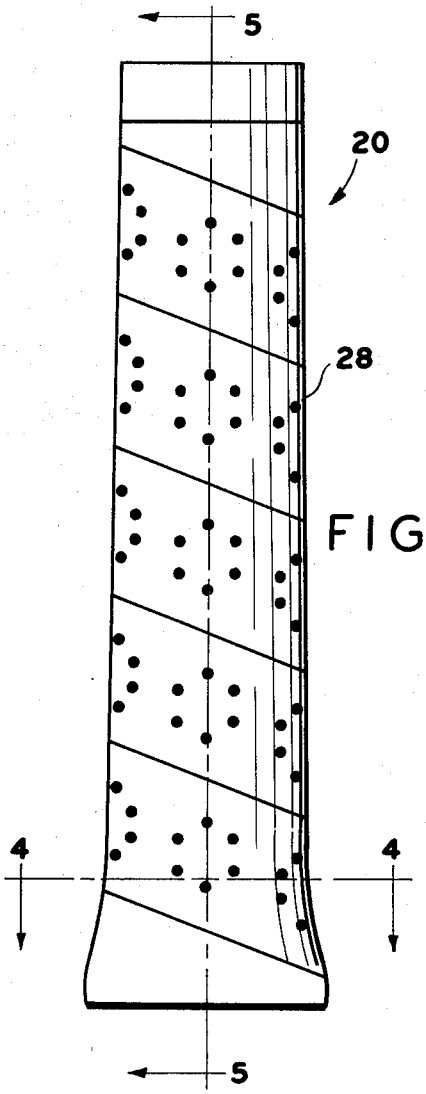
FIG. 3 is a front elevational view of the grip of the present invention.
Figure 5:
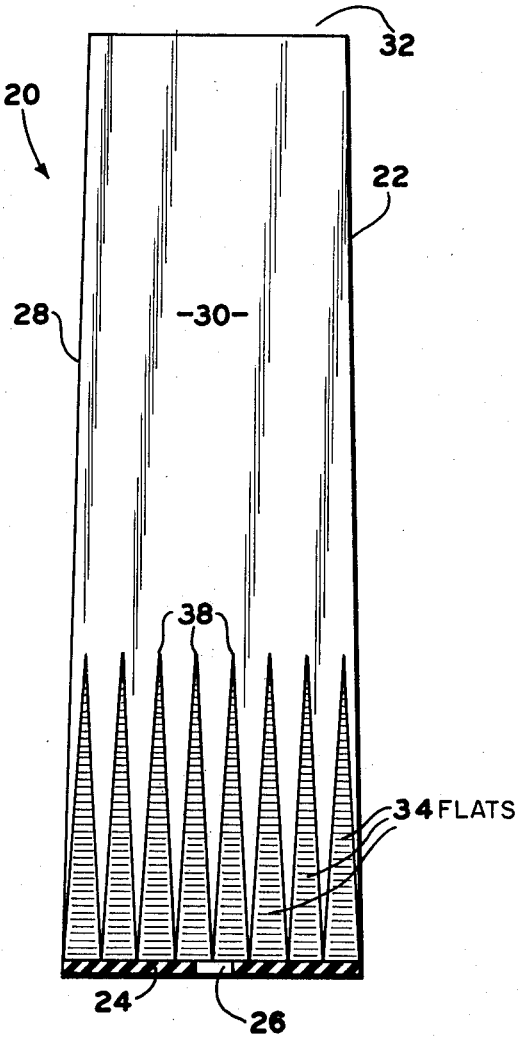
FIG. 5 is a development view taken along line 5—5 in FIG. 3 illustrating the interior surface of the grip along its axial extension.
Figure 4:
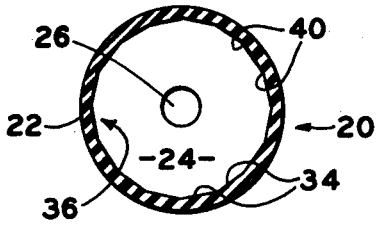
FIG. 4 is a sectional view taken along the line 4—4 in FIG. 3 illustrating the interior of the grip of the present invention adjacent the closed end thereof.

The grip 20 may be seen in detail by reference to FIGS. 3, 4, and 5. The grip 20 is molded as a one-piece structure of rubber, a rubber compound, plastic or the like. The grip comprises a generally annular axially extending, relatively thin walled sleeve 22 and an end cap or closed end 24. The sleeve 22 is intended to be slipped onto the grip portion 16 of the tennis racket handle until the end cap or closed end 24 contacts the bottom of the handle as is well known in the art. The end cap 24 includes an aperture 26 therethrough to allow air trapped during the assembly of the grip to the handle to escape.

The exterior surface of the grip 28 may be buffed to improve the feel of the grip and may include various designs for pleasing appearance and/or increased resistance to slippage from the users hand. The axial sleeve 24 may be radially outwardly flaired adjacent the closed end 24 thereof.

The interior surface 30 of sleeve 22 is generally annular adjacent the top or open end 32 thereof and comprises a plurality of generally equally spaced flats 34 formed therein adjacent the closed end 24 thereof. The flats 34 meet immediately adjacent the end cap 24 to form an equilateral polygon 36 of sixteen sides thereat. The flats are each of circumferentially decreasing extension, or generally in the form of an isosceles triangle, as they extend away from the end cap and terminate at a point, or apex, 38 intermediate the end cap 24 and the open end 32 of the sleeve. The separation of the termination points or apex, 38 from the end cap 24 is in the range of 15% to 60% of the axial length of the grip and preferably in the range of 15% to 25% of the axial length of the grip.

In operation, the molded, one-piece, slip-on grip is slipped onto the handle 14 of a tennis racket 10 having an octagonal cross-sectional shape. It is noted that while the grip of the present invention is, with its 16 internal flats terminating at an equilateral polygon of 16 sides, particularly well suited for octagonally shaped handles, it is also usable with square, hexagonal and other cross-sectionally shaped handles. A lubricant and/or adhesive solvent may be utilized to facilitate the assembly of the grip to the handle. The great plurality of corners 40 formed by the equilateral polygon of sixteen sides 36 and the flats assure that a plurality thereof will receive and retain the corners 18 of the handle 14. The relatively shallow corners in the interior surface 30 of the grip not engaged with corners 18 of the handle will be substantially flattened and closely conform to the sides 17 of handle.

Although this invention has been described in its preferred form with a certain degree of particularity, it is understood that the present disclosure of the preferred form has been made by way of example only and that numerous changes in the details of construction and combination and arrangement of parts may be resorted to without departing from the spirit and the scope of the invention as hereinafter claimed.

I claim:

1. An improved molded, one-piece, slip-on grip for non-rotational retention on the elongated handles of tennis rackets and the like of the type comprising an elongated sleeve having an open end and a closed end, said improvement comprising:

a plurality of axially extending circumferentially spaced internal flats formed in the internal surface of said grip and forming an equilateral polygon adjacent the closed end thereof, said flats are of decreasing circumferential extension away from said closed end and terminate at an axial distance from said closed end which is in the range of 15% to 65% of axial length of said grip.

2. The improved grip of claim 1 wherein said axial distance is in the range of 15% to 25% of the axial length of said grip.

3. The improved grip of claim 1 wherein the exterior surface of said grip is flaired radially outwardly at said closed end.

4. The improved grip of claim 1 wherein said flats are generally in the form of isosceles triangles, the bases of said triangles defining said polygon and the apex of said triangles being spaced from said closed end by an axial distance in the range of 15% to 65% of the axial length of said grip.

5. The improved grip of claim 1 wherein said substantially equilateral polygon is of 16 sides.

* * * * *